United States Patent [19]

Elder

[11] Patent Number: 4,913,339

[45] Date of Patent: Apr. 3, 1990

[54] TRAY HOLDER FOR LITER BOTTLES

[75] Inventor: Jerome E. Elder, Blaine, Minn.

[73] Assignee: International Paper Company, Purchase, N.Y.

[21] Appl. No.: 395,694

[22] Filed: Aug. 18, 1989

[51] Int. Cl.[4] ..... B65D 5/48

[52] U.S. Cl. ..... 229/120.14; 206/427; 229/161

[58] Field of Search ..... 206/427, 193, 197; 229/120.14, 161, 178

[56] References Cited

U.S. PATENT DOCUMENTS

| | | | |
|---|---|---|---|
| 2,076,844 | 4/1937 | Holmes | 229/161 |
| 3,703,982 | 11/1972 | Daughtry | 229/161 |
| 3,750,935 | 8/1973 | Akkerman | 206/193 |
| 4,240,546 | 12/1980 | Stone | 206/193 |
| 4,327,829 | 5/1982 | Hughes | 206/193 |
| 4,371,366 | 2/1983 | Bower et al. | 229/178 |
| 4,658,961 | 4/1987 | Tamura | 229/161 |

*Primary Examiner*—Gary Elkins

*Attorney, Agent, or Firm*—Walt Thomas Zielinski

[57] ABSTRACT

A one piece substantially rectangular corrugated paperboard blank is folded into a comparatively shallow tray type container for packaging a plurality of relatively tall bottles of potable liquid in a compact relatively immovable non-wobbling cluster so that the packages may be stacked one upon the other. A top panel has portions scored and cut from each other to form reinforcing inner end parts and a vertical center panel which forms a bridge across the tray to keep the sides from spreading and it also forms a dunnage bulkhead between the halves of the bottles to cushion them from each other in a tight condition within reinforcing corners which embrace the bottles securely.

10 Claims, 6 Drawing Sheets

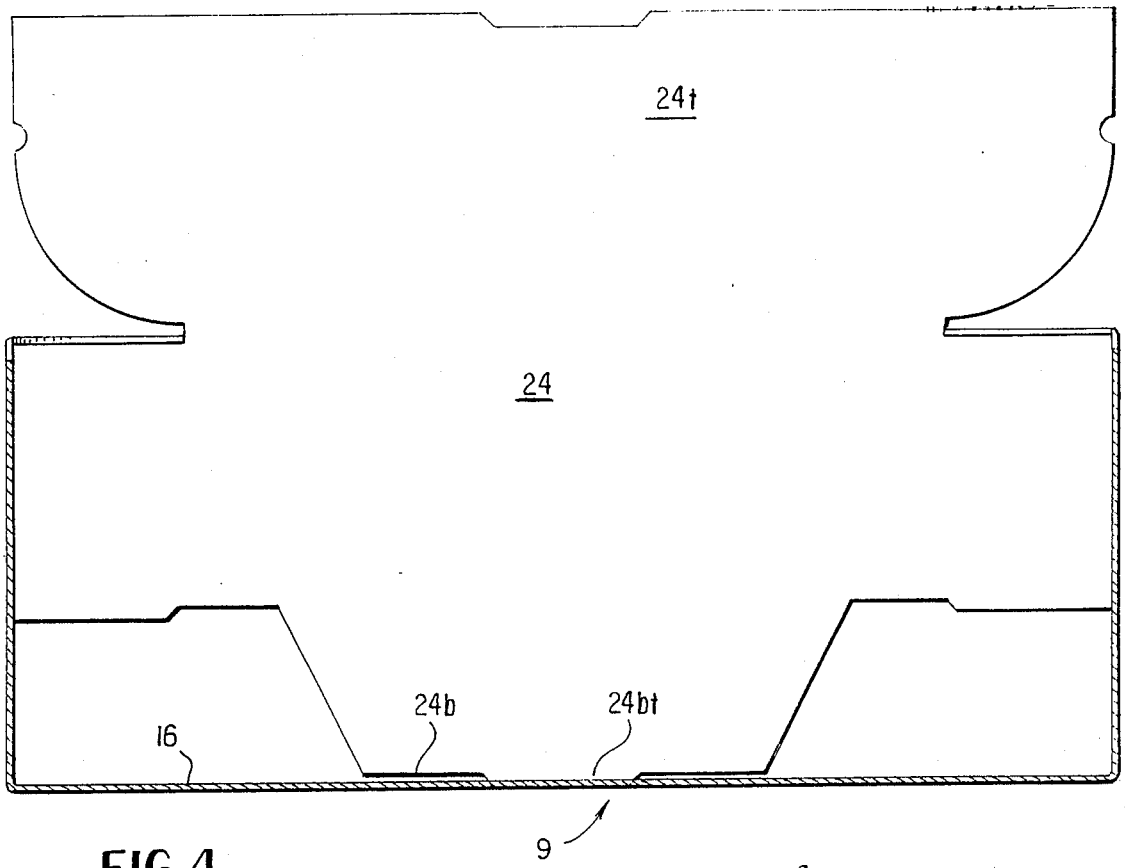
FIG. 4
FIG. 5
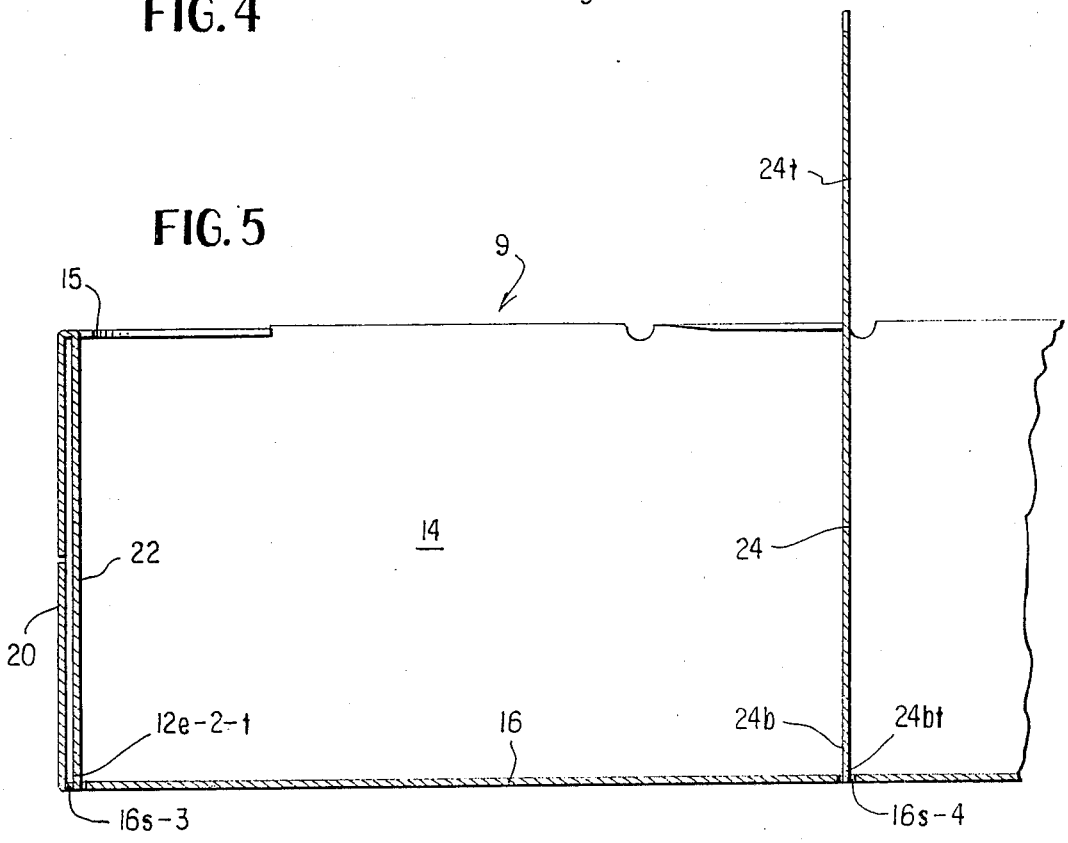

TRAY HOLDER FOR LITER BOTTLES

BACKGROUND OF THE INVENTION

This invention relates to a corrugated paperboard carton blank and carton, known in the trade as a tray for packaging bottles, particularly bottles of potable liquid of the currently sold and used one and two liter sizes and larger.

A corrugated paperboard carton approximately 14 inches long and 10 inches wide will contain 12 one liter bottles standing up and closely packed together in rows, but since such a bottle is approximately 11 inches tall the carton would have to be more than 11 inches tall to completely enclose a cluster of these bottles.

Since the packaging industry and its customers are obviously interested in economy in the use of packaging material it has been found desirable to package for instance 12 one liter bottles in a tray which is only about 4 inches tall. To package 8 two liter bottles the tray type container must be 18 inches long, 9 inches wide and preferably just under 5 inches high.

But problems arise in the use of such shallow containers. If the ends and particularly the sides are not strongly reinforced, they tend to spread apart allowing the bottles to wobble around loosely, a particular disadvantage when it is attempted to stack trays of bottles one upon another, the loose bottles failing to provide adequate support for the containers above so that the stacked up containers tend to fall.

It is accordingly the general object of this invention to provide a tray type carton for packaging fairly large bottles which is low enough in height to provide real economy of material, and which can be made from a substantially rectangular and thus economical one piece blank which is cut and scored in such a way as to provide various features for substantial reinforcement in an erected carton. These desired features include means to prevent the sides of the carton from spreading and allowing the bottles to become loose in the container and also to provide dunnage, i.e., padding to separate half of the bottles in the container from the other half so as to keep them tightly packed together in an embracing containment.

SUMMARY OF THE INVENTION

As will appear in the more detailed description and drawings, the tray type carton of the invention is substantially rectangular in shape and is formed from a one piece blank which is substantially rectangular in shape preferably made of corrugated paperboard.

A preferred form of the blank has front, top, back and bottom panels foldable with respect to each other to form a box structure. Before complete erection of the carton the box structure can be shipped as a tube in collapsed flat form. All of the panels have side flaps which in the erected form are folded and superimposed with respect to each other to form multi-layered outer carton end panels.

The top panel has been scored and cut so as to provide downwardly extending reinforcing inner end panels in the carton. Also provided from the top panel is a vertical center panel in the carton which forms a bridge rigidly holding the sides of the carton together and providing a dunnage bulkhead between the groups of bottles in the two halves of the carton. These top panel parts also have been cut in such a way as to leave arcuate shaped reinforcing portions in the top of the carton at its corner which embrace the adjacent bottles in the carton additionally tending to hold the clusters of bottles in rigid form so they can be readily stacked one on top of the other in their cartons.

DESCRIPTION OF THE DRAWINGS

FIG. 4 is a section view taken on the lines 4—4 of FIG. 3.

FIG. 5 is a partial section view taken on the lines 5—5 of FIG. 3.

DETAILED DESCRIPTION OF THE INVENTION

Figure 1:
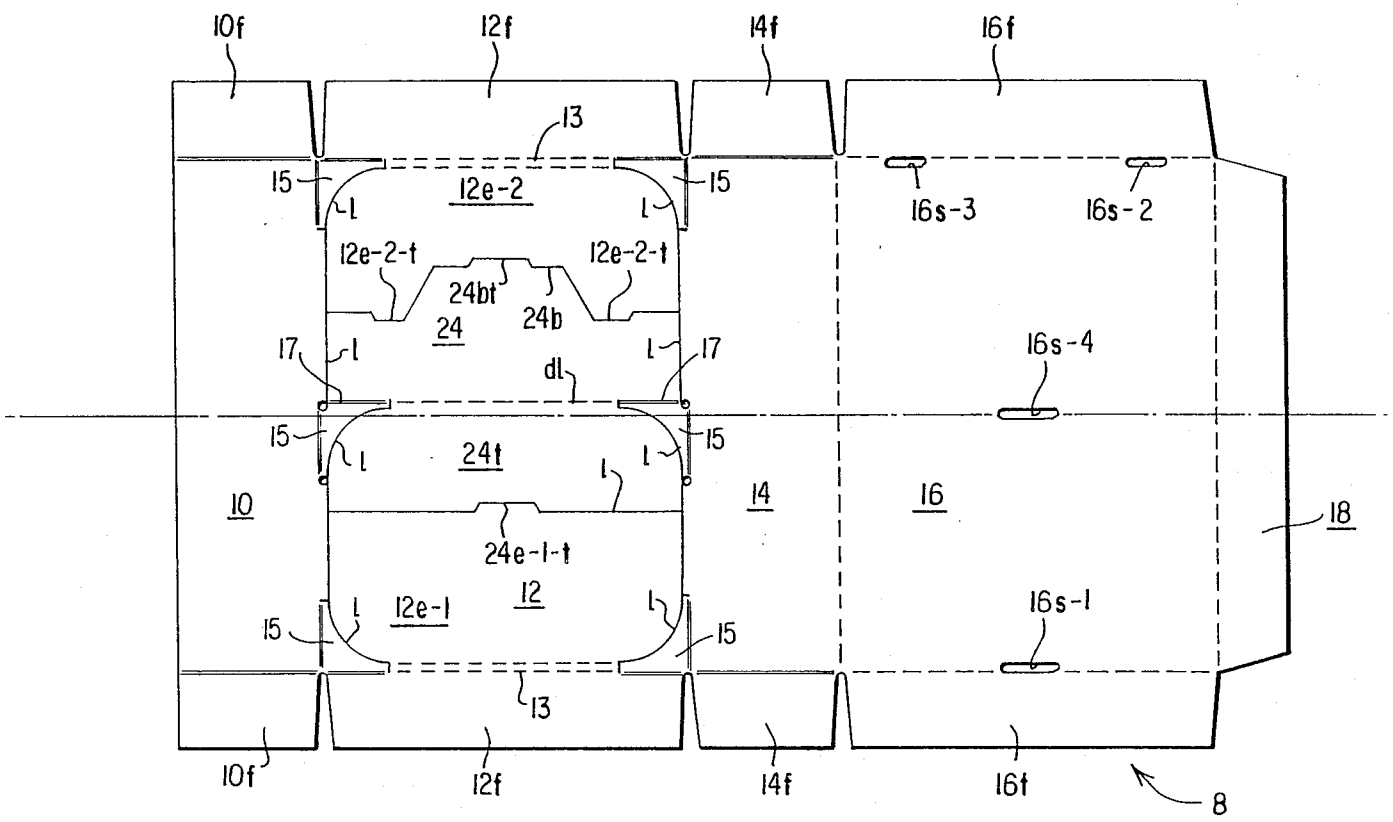
FIG. 1 is a plan view of a paperboard carton blank laid out flat for a carton to package 12 one liter bottles.
Figure 9:
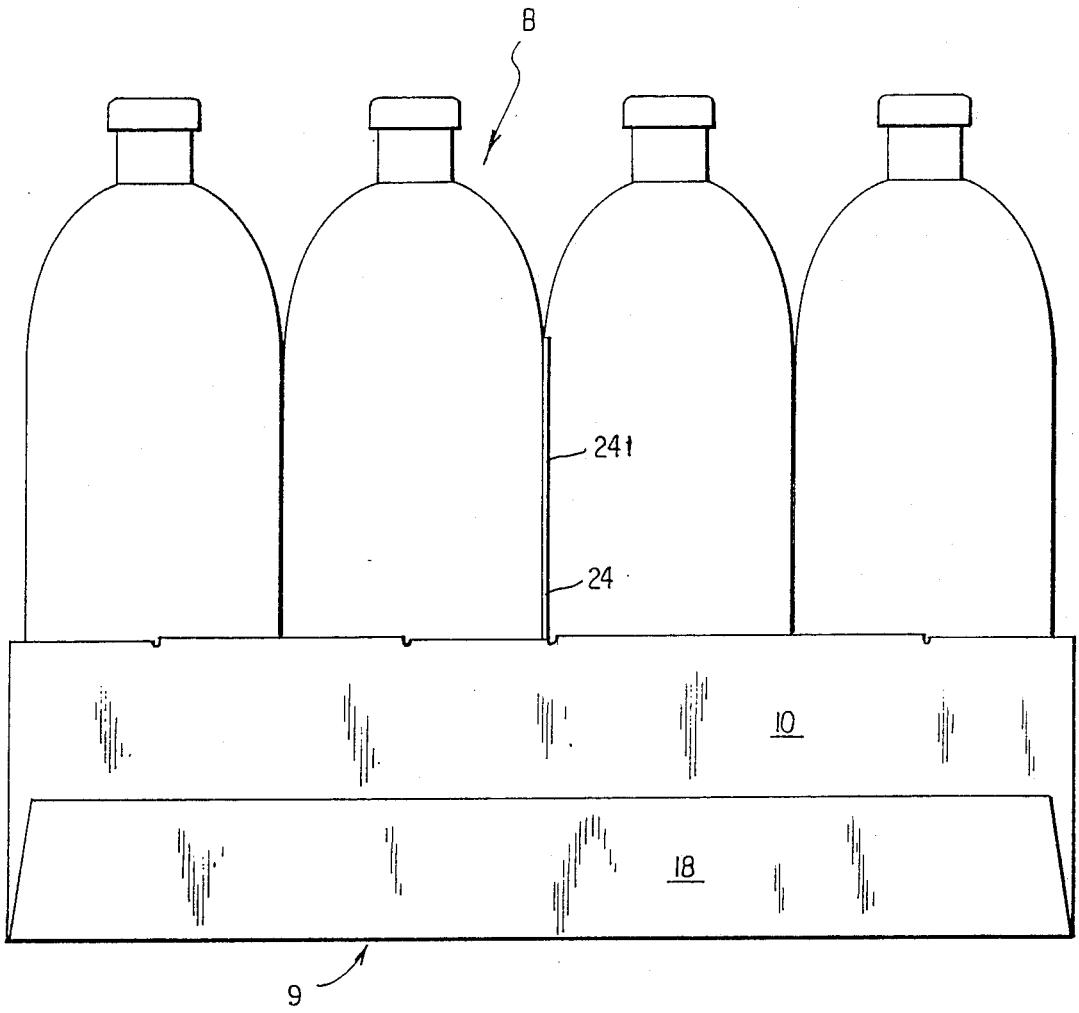
FIG. 9 is a side elevation view of the carton of FIGS. 2 through 5 inclusive, showing in the carton four out of the twelve one liter bottles which the carton is designed to contain, the remaining bottles being behind and out of sight.

A one piece corrugated paperboard carton blank is indicated at 8 in FIG. 1 for making a carton indicated at 9 in FIGS. 2–5 inclusive and also in FIG. 9. The latter shows the near row of the bottles indicated at B contained in the carton.

Figure 2:
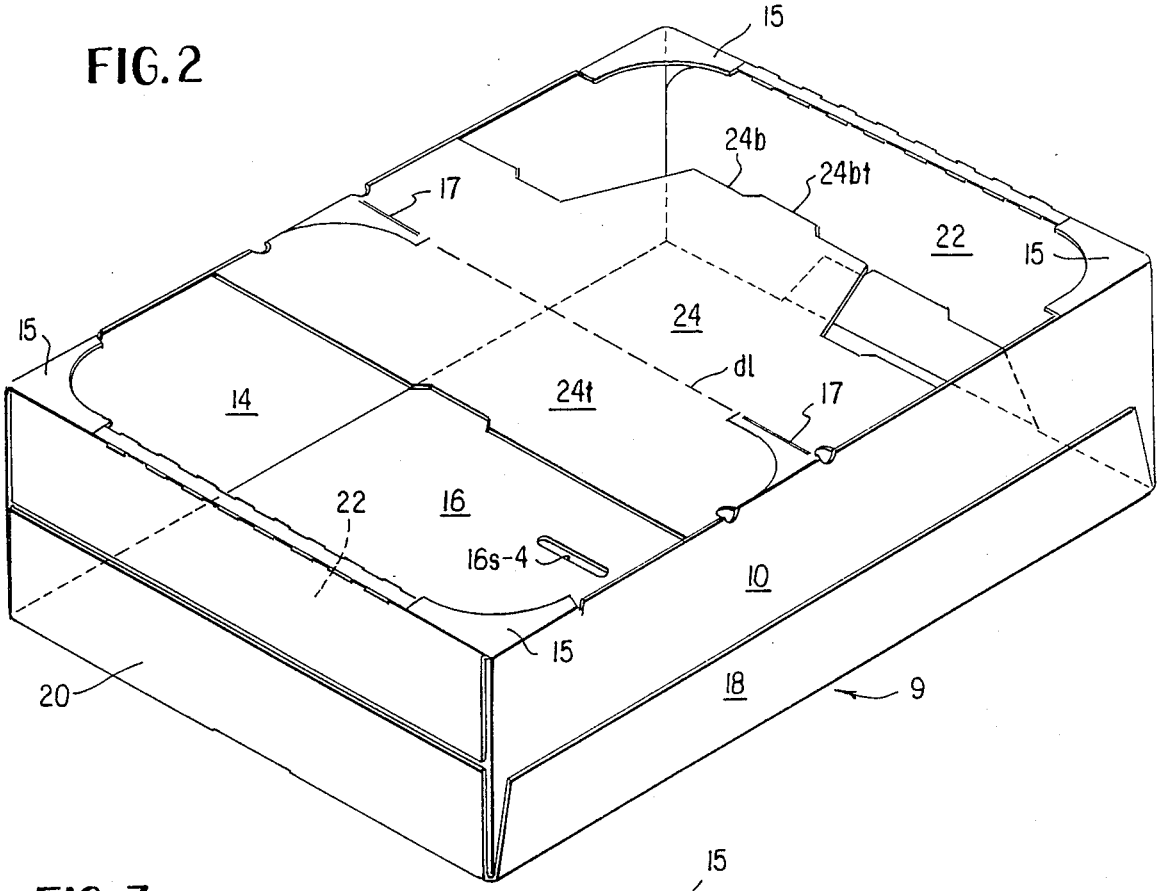
FIG. 2 is a perspective view of the assembled and partially erected carton made from the blank of FIG. 1.
Figure 3:
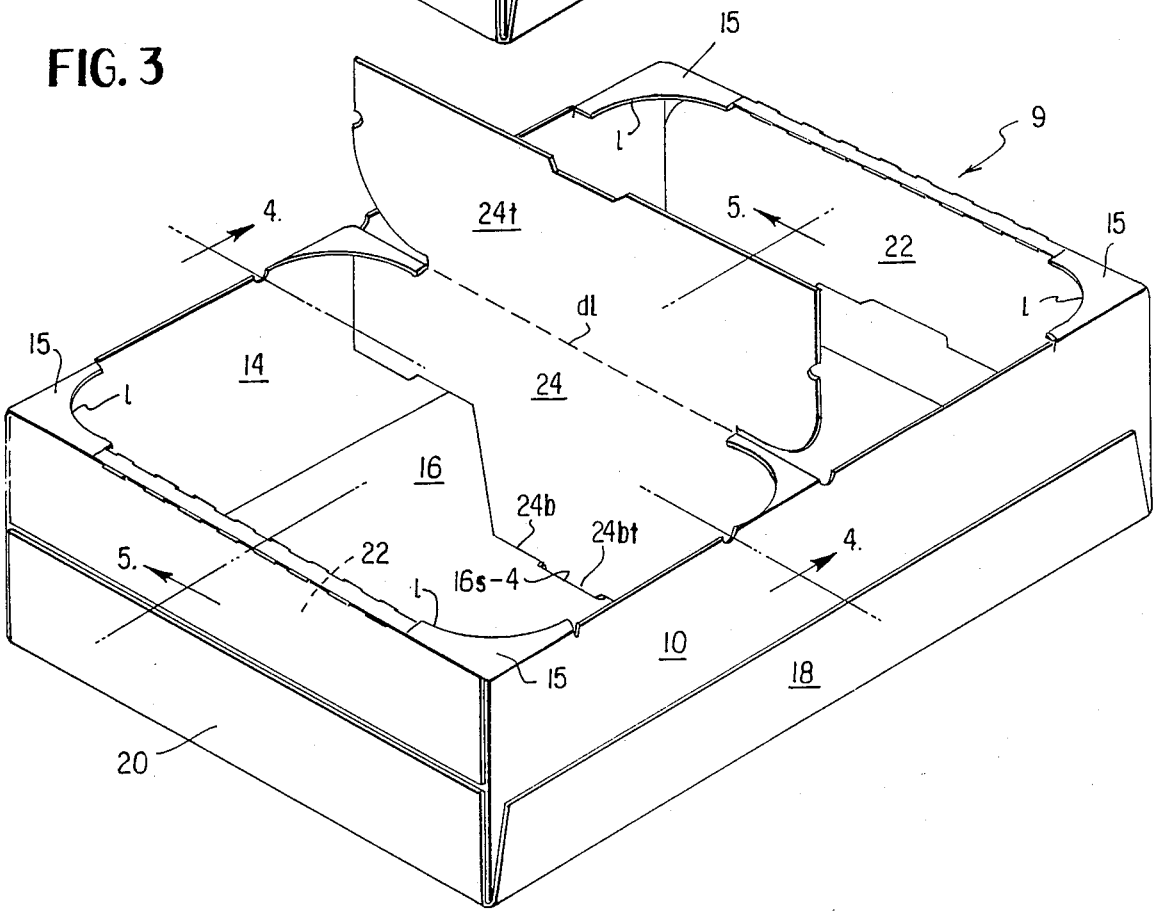
FIG. 3 is a perspective view of the fully assembled and completely erected carton shown in FIG. 2.

Referring particularly to FIG. 1 the blank 8 has a front panel 10, a top panel 12, a back panel 14, a bottom panel 16 and an outer front panel serving as a glue tab 18, all integrally connected and foldable with respect to each other to form a box structure when the outer front panel or glue tab 18 is glued or otherwise secured as by stapling to the front panel 10 to form a collapsible tube which may be shipped flat. Alternatively, the glue tab 18 could be hinged to the front panel to be glued to the bottom panel. The panels 10, 12, 14 and 16 have pairs of respective side flaps **10*f*, 12*f*, 14*f* and 16*f* which are foldable so as to be superimposed with respect to each other to form outer carton end panels indicated at 20 when the blank is erected into a carton 9 as seen in FIGS 2 and 3**.

The top panel 12 is scored and cut into several separately functional portions folded into place when the blank is erected into the completed carton. These include inner carton end portions **12*e*-1 and 12*e*-2 as seen in the blank, FIG. 1 which are foldable downwardly along score lines 13 to form inner end carton panels 22 in the erected carton as seen in FIGS. 2 and 3**.

The top panel 12 also has a center panel portion 24 which is cut and scored as seen in FIG. 1 so as to be foldable and separable from other portions of the top panel to form a vertical center panel in the erected carton as seen in FIGS. 3–5 and 9 with a bottom edge **24*b* in proximity to the bottom panel 16 and a top portion 24*t* extending substantially above the top panel as seen in FIGS. 3–5 and 9**.

Referring back to FIG. 1 the inner end portions **12*e*-1 and 12*e*-2 and the center panel portion 24 are separable from each other and from other portions of the top panel by cuts indicated by the solid lines 1. When the center panel 24 is rotated into its vertical position in the carton it pivots around a line across the center of the carton indicated by the dotted line d1 in FIGS. 1, 2 and 3**.

Scores 17 are provided to facilitate rotation of the center panel on the line d1.

As also best seen in FIG. 1 the bottom panel 16 has end slots **16*s*-1 and 16*s*-2 and 16*s*-3. The inner end portion 12*e*-1 of the blank has a tab 12*e*-1-t engageable in the end slot 16*s*-1. The other inner end portion 12*e*-2 has a pair of tabs 12*e*-2-t engageable in the end slots 16*s*-2 and 16*s*-3. The bottom panel 16 also has a center slot 16*s*-4. The center panel has a tab 24*bt* located in its bottom edge 24*b* and engageable in the center slot 16*s*-4** to lock he center panel in place.

As best seen in FIGS. 3 and 4 the center panel forms a bridge between the front 10 and the back 14 of the carton providing reinforcement against spreading apart of these carton sides and loosening of the contained bottles.

And as best seen in FIG. 9 the center panel 24 also provides dunnage or padding both separating and protecting the adjacent row of bottles B helping them to remain tightly packed together against each other, against the corners and sides of the carton and against the center panel 24 itself.

It is important that the arcuate portions of the cut lines 1 in the top panel 24 of the blank and of the carton are arranged to leave reinforcing corner portions 15 in the top panel 12 of the carton as best seen functionally located in FIGS. 2 and 3.

Figure 6:
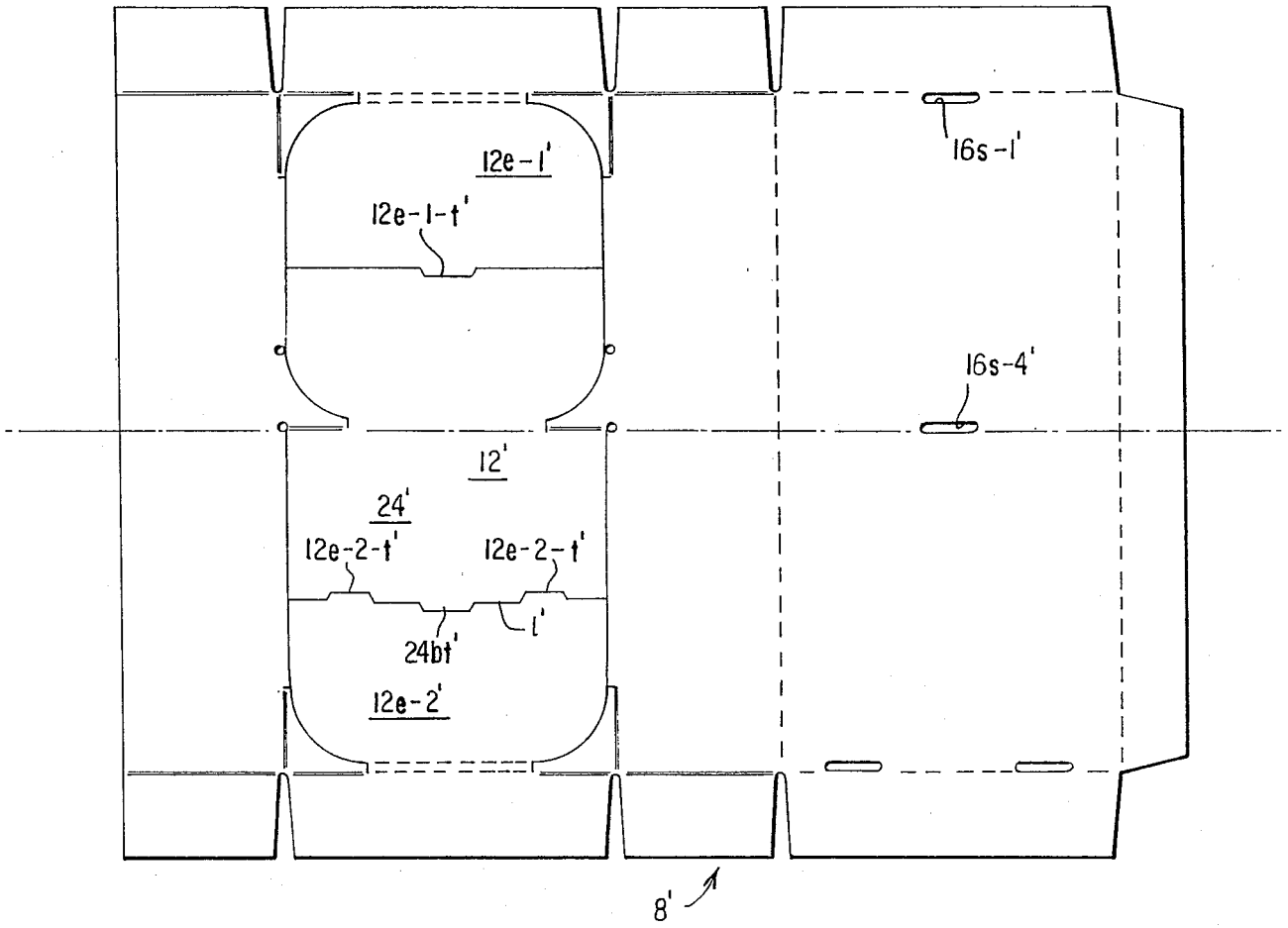
FIG. 6 is a plan view of a paperboard carton blank laid out flat for a carton to contain 8 two liter bottles.
Figure 7:
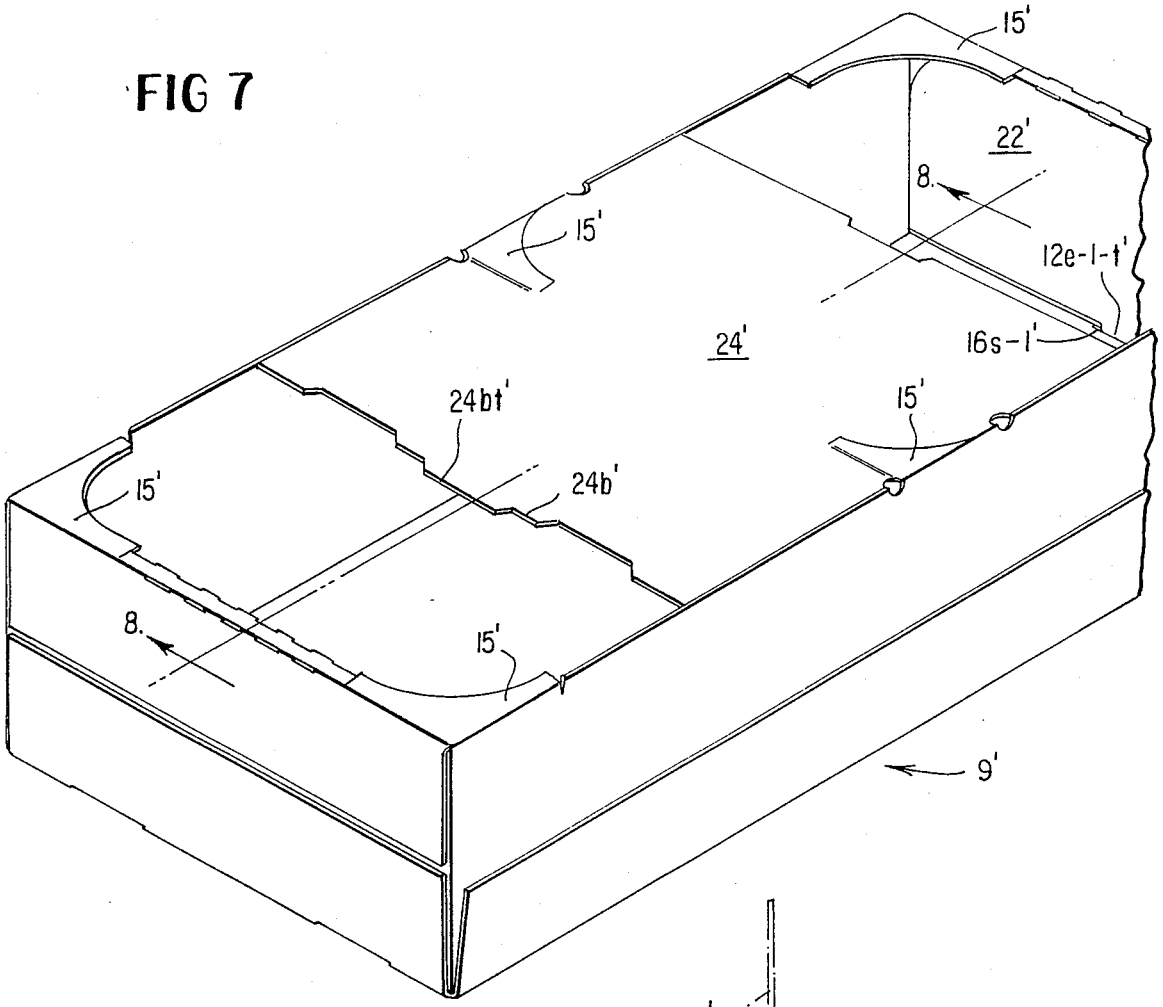
FIG. 7 is a partial perspective view of a not quite fully erecte carton made from the blank of FIG. 6.
Figure 8:
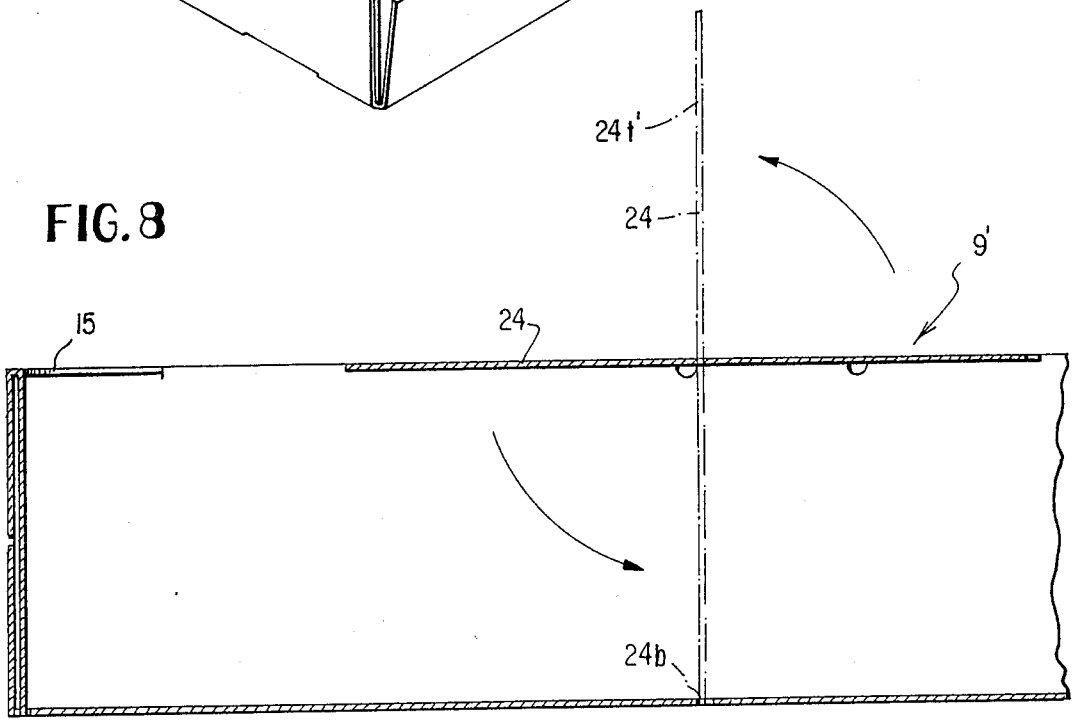
FIG. 8 is a partial section view taken on the lines 8—8 of FIG. 7 except that the center panel is also indicated as fully erected.

FIGS. 6, 7 and 8 show a slightly altered form of the blank and carton for packaging 8 two liter bottles.

Since a two liter bottle is substantially taller and has a larger diameter than the one liter bottle, the tray type carton to accommodate it is proportionately longer than the one shown and described for the one liter bottle in FIGS. 1–5 and 9 and also it is preferably substantially deeper as best seen in the tray indicated by 9' in FIG. 7. But despite the height of the carton of FIGS. 7 and 8, its length as viewed in FIG. 6 is sufficiently comparatively greater than that of the carton of FIGS. 1–5 that the cut edges between the inner end portion **12*e*-2' and the center panel 24' along the cut line 1' do not need to be offset with respect to each other so much as the similar edges in FIG. 1 in order for the bottom edges of these parts to reach the bottom of the carton. Otherwise the tab 24*bt'* is engaqed to the center slot 16*s*-4' in the bottom panel 16' and the tabs 12*e*-2-*t'* on the inner end panel 12*e*-2' engage the end slots 16*s*-2' and 16*s*-3'. Likewise the tab 12*e*-1-*t* on the inner end panel 12*e*-1' engages the end slot 16*s*-1**.

The shallow tray type carton of the invention with heavily reinforced end walls, corner reinforcement on its top and the center panel combining the functions of a reinforcing bridge to hold the sides rigid and a dunnage baffle between clusters of bottles in the two halves results in a container which when filled with bottles can be safely stacked one on top of the other and with a great saving in material and cost as compared to a box to entirely enclose the contents.

What is claimed is:

1. A one piece paperboard blank for a carton to package bottles, said blank comprising front (10), top (12), back (14) and bottom (16) panels foldable with respect to each other to form a box structure:

(a) some of said panels having at least some of pairs of side flaps (**10*f*), (12*f*), (14*f*) and (16*f*) foldable to form outer carton and panels (20**);

(b) said top panel having inner carton end portions (**12*e*-1) and (12*e*-2) cut and scored so as to be foldable and separable from other portions of said top panel to form inner end carton panels (22**) in the erected carton;

(c) said top panel also having a center panel portion (24) cut and scored so as to be foldable and separable from other portions of said top panel to form a vertical center panel in the erected carton with a bottom edge (**24*b* ) in proximity to the bottom panel and a top portion (24*t***) extending substantially above the top panel in the erected carton.

2. A paperboard carton blank as set forth in claim 1 in which the bottom panel has end slots (**16*s*-1), (16*s*-2), (16*s*-3) and each of the inner carton end portions has at least one tab (12*e*-1-t), (12*e*-2**-t) engageable in a said end slot.

3. A paperboard carton blank as set forth in claim 1 in which the bottom panel has a center slot (**16*s*-4) and the center panel portion has a bottom tab (24*bt***) on its bottom edge engageable in said center slot.

4. A paperboard carton blank as set forth in claim 1 in which the inner carton end portions and the center panel portion are cut so as to leave arcuate corner reinforcing portions (15) in said top panel.

5. A paperboard carton blank as set forth in claim 1 in which one of the said fron and bottom panels has a glue tab 18 by which said one can be secured to the other in a manufacturer's joint so as to form a partially erected carton which can be collapsed into a flattened tube.

6. A carton formed from the blank as set forth in claim 1.

7. A paperboard carton for packaging bottles, said carton comprising front (10), top (12), back (14) and bottom (16) panels folded with respect to each other to form a box structure:

(a) some of said panels having at least some of pairs of side flaps (**10*f*), (12*f*), (14*f*) and (16*f*) folded and superimposed with respect to each other so as to form outer carton end panels (20**);

(b) said carton having inner end panels (22) formed as portions of said top panel and which are scored, cut, folded and separated from other portions of said top panel;

(c) said carton also having a center panel (24) which is also formed as a portion of said top panel and which is stored, cut, pivotally folded and separated from other portions of said top panel so as to form said center panel in vertical position and having a bottom edge part (**24*b*) in proximity to the bottom panel and a top portion (24*t***) extending substantially above the top panel.

8. A paperboard carton as set forth in claim 7 in which the bottom panel has end slots and each of the inner end panels has at least one tab engaged in a said end slot.

9. A paperboard carton as set for in claim 7 in which the bottom panel has a center slot and the center panel has a bottom tab on its bottom edge engaged in said center slot.

10. A paperboard carton as set forth in claim 7 in which the top panel has arcuate corner reinforcing portions (15).

* * * * *